US011460164B1

(12) United States Patent
Yu et al.

(10) Patent No.: US 11,460,164 B1
(45) Date of Patent: Oct. 4, 2022

(54) VEHICLE SIGNAL LIGHT STRUCTURE AND DAYTIME RUNNING LIGHT

(71) Applicant: TAN DE TECH CO., LTD, Douliu (TW)

(72) Inventors: Jyun Sian Yu, Douliu (TW); Chung Chiang Pan, Douliu (TW); Chao Pai Lee, Douliu (TW)

(73) Assignee: TAN DE TECH CO., LTD., Douliu (TW)

( * ) Notice: Subject to any disclaimer, the term of this patent is extended or adjusted under 35 U.S.C. 154(b) by 0 days.

(21) Appl. No.: 17/519,196

(22) Filed: Nov. 4, 2021

(30) Foreign Application Priority Data

Aug. 5, 2021 (TW) ..... 110128821

(51) Int. Cl.
*F21S 43/239* (2018.01)
*F21S 43/20* (2018.01)
*F21W 103/55* (2018.01)

(52) U.S. Cl.
CPC ..... *F21S 43/239* (2018.01); *F21S 43/26* (2018.01); *F21W 2103/55* (2018.01)

(58) Field of Classification Search
CPC ..... F21S 43/30; F21S 43/31; F21S 43/315
See application file for complete search history.

(56) References Cited

U.S. PATENT DOCUMENTS 5,418,384 A * 5/1995 Yamana ..... G02B 6/0046 399/221
5,590,945 A * 1/1997 Simms ..... G02B 6/0038 362/555
5,914,760 A * 6/1999 Daiku ..... G02B 6/0053 349/95
8,328,403 B1 * 12/2012 Morgan ..... F21V 13/02 362/616
9,960,303 B2 * 5/2018 Morgan ..... H01L 31/052
2008/0252986 A1 * 10/2008 Ijzerman ..... G02B 6/0048 359/641
2015/0055371 A1 * 2/2015 van de Ven ..... G02B 6/0045 362/612
2015/0184823 A1 * 7/2015 Ladenburger ..... F21S 43/31 362/511
2020/0041885 A1 * 2/2020 Peeters ..... G02B 6/0003

FOREIGN PATENT DOCUMENTS

CN 102818203 A 12/2012
TW 202024522 7/2020

* cited by examiner

*Primary Examiner* — Eric T Eide
(74) *Attorney, Agent, or Firm* — Muncy, Geissler, Olds & Lowe, P.C.

(57) ABSTRACT

A vehicle signal light structure includes a light guide, two light source modules, and a collimator. The light guide includes an elongated light output surface, a light incident surface being disposed at both sides of the light output surface, and a light guide surface being disposed below the light output surface. The light guide surface is tilted upward from the light incident surface to the center of the light guide. The light guide surface includes a plurality of V-shaped microstructures defining a light guide structure. The light source modules are disposed at the light incident surface of the light guide. The collimator has a light incident surface disposed at the light output surface of the light guide. A light passing through the light incident surface of the light guide is reflected by the light guide surface and directs to the light output surface, then, is collimated by the collimator.

7 Claims, 7 Drawing Sheets

VEHICLE SIGNAL LIGHT STRUCTURE AND DAYTIME RUNNING LIGHT

BACKGROUND

Technical Field

The present disclosure is directed to a vehicle signal light structure deploying side lights to provide an elongated light pattern.

Related Art

An elongated vehicle light as disclosed in TW202024522, in order to maintain certain light intensity, a plurality of light sources are arrayed in a linear light pattern, ensuring each section of the elongated light to meet various requirements, which also means a plurality of light sources are required according to the length of the light.

Another elongated vehicle light as disclosed in CN102818203A deploys a side light, in which a light source is disposed at a side of an elongated light guide, the light being reflected in the light guide and directs to the elongated light output surface. The benefit of deploying the side light is to reduce the quantity of the light sources; however, the light undergoes total reflection in the light guide, the light at a certain angle being reflected by the microstructure behind the light guide and directs to the light output surface in the front, unable to ensure the elongated light source distribution at each position. Besides, the farther away from the light source the light is arranged, it is less likely for the light to reach the light output surface, the brightness decreases accordingly.

SUMMARY

The present disclosure is directed to a vehicle signal light structure comprising a light guide, at least two light source modules, and a collimator. The light guide has an elongated light output surface, a light incident surface being disposed away from opposite ends of the light output surface, and a light guide surface being disposed below the light output surface. The light guide surface is tilted upward from the light incident surface to the center of the light guide. The light guide surface has a plurality of V-shaped microstructures defining a light guide structure. Alight passing through the light incident surface of the light guide is reflected by the light guide surface, directing toward the light output surface. The two light source modules, being individually disposed away from opposite ends of the light incident surface of the light guide. An extending direction of the collimator is identical to an extending direction of the light output surface of the light guide. The light incident surface of the collimator faces to the light output surface of the light guide. The light from the light output surface of the light guide is collimated by the collimator, and then shines outside of the light output surface of the collimator.

In some embodiments, the vehicle light deploys side lights to provide sufficient light intensity to meet various requirements, apart from this, reduce the volume of the light.

In some embodiments, the collimator has an identical contour in an extending direction. Longitudinal sections of the light guide are in two symmetrical wedges.

In some embodiments, partial light emitted by the light source modules is reflected at least twice in the light guide. The light incident surface of the light guide comprises a plurality of light source modules being spaced apart from the light output surface of the light guide in various distances to provide sufficient light intensity.

In some embodiments, the light guide surface at various positions comprises a plurality of V-shaped microstructures with various distribution densities to adjust the light intensity at various positions in an extending direction (the Y direction).

The present disclosure further provides a daytime running light comprising the vehicle signal light structure of the above-mentioned.

DETAILED DESCRIPTION

The following description is in accordance with common understanding of those skilled in the art. A light output direction of a linear vehicle light is referred as front. Please also refer to FIG. 2, a positive direction of the Z direction is referred as front, the Y direction being referred as an extending direction of the linear vehicle light, the X direction being referred as a width of the vehicle light.

Figure 2:
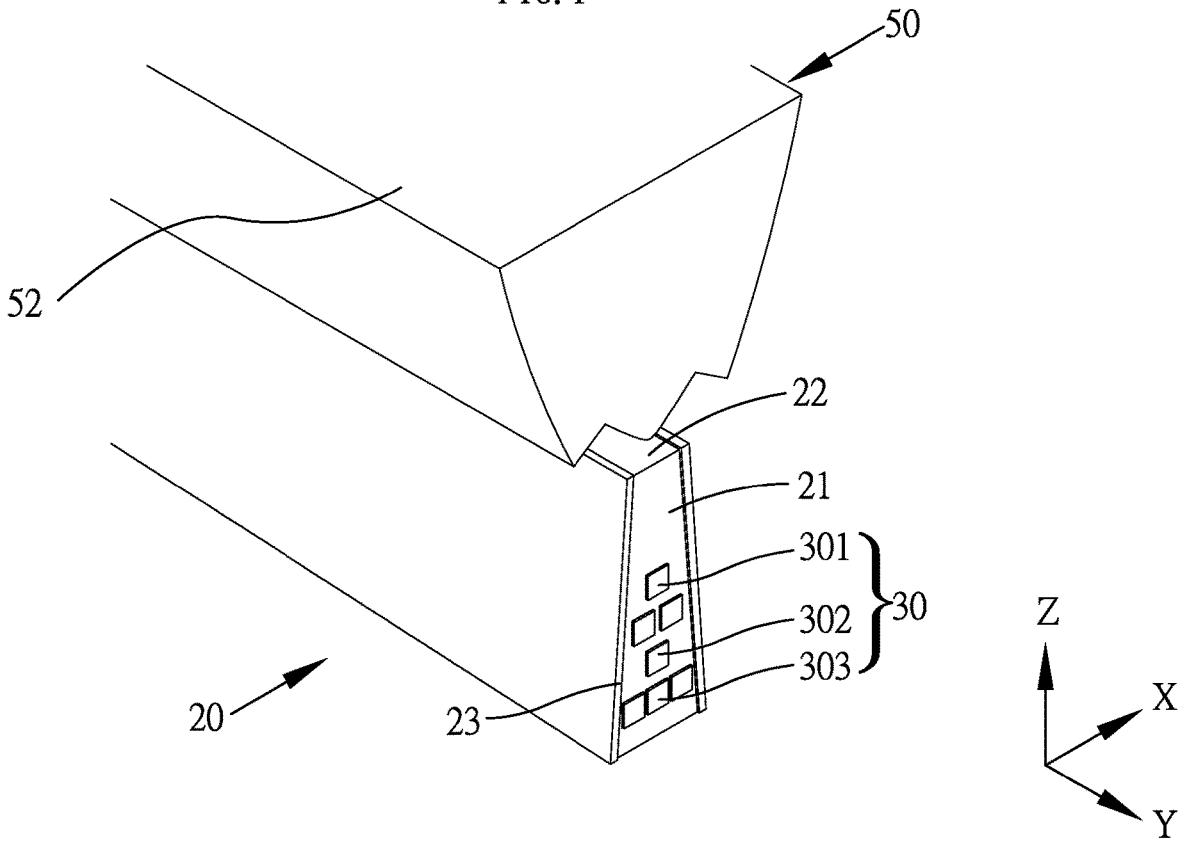
FIG. 2 is a partial enlarged view showing a side section of the vehicle signal light structure.

The instant disclosure provides an embodiment of an internal structure of an elongated daytime running light as shown in FIG. 2 deploying side lights (light source modules 30) to transform the light source to an elongated linear light source by a light guide 20, the light being focused and condensed by a collimator 50 to meet the regulation requirement. The light structure also applies on various vehicle lights, e.g., low beam lights, direction lights, positions lights, tail lights, brake lights, backup lights or decorative lights and is not limited to the those mentioned above.

Figure 1:
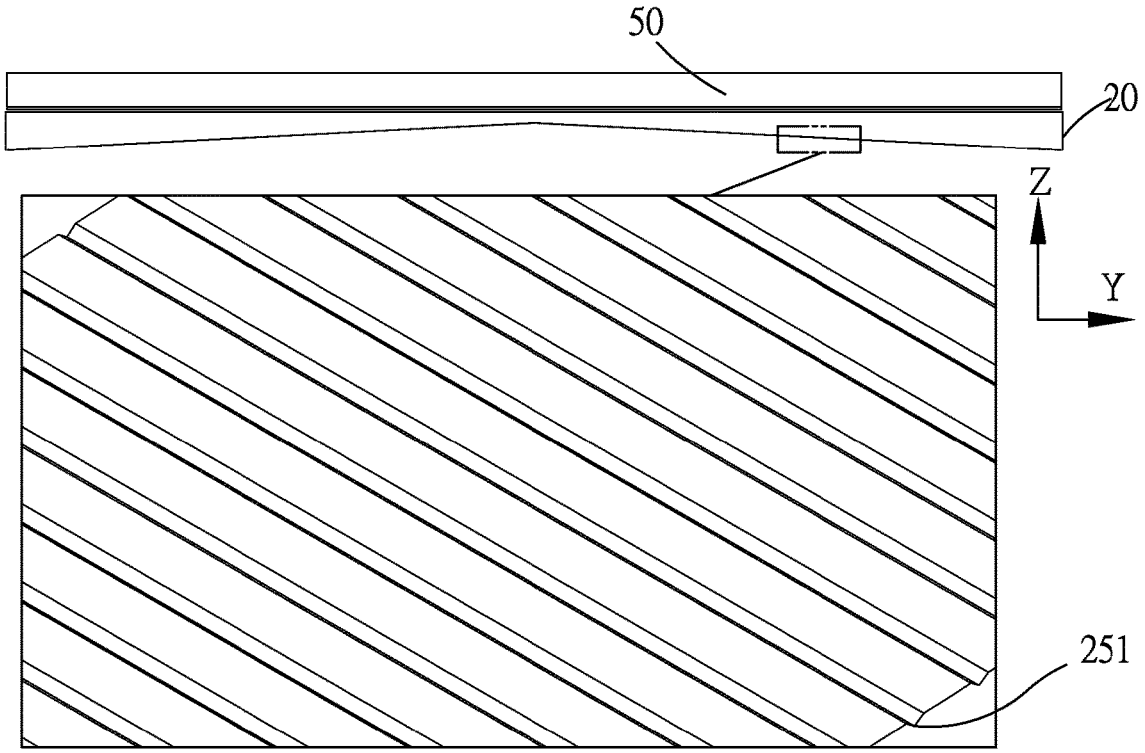
FIG. 1 is a schematic view showing a vehicle signal light structure.

Please refer to FIG. 1 and FIG. 2, the instant disclosure provides a light structure comprising the light guide 20, at least two light source modules 30, and the collimator 50. The light guide 20 is served in elongated shape to correspond to and to provide the linear light pattern. The light guide 20 comprises a light output surface 22 at an upper side thereof. The light guide 20 comprises a light incident surface 21 at a side of the left and right (the Y direction) thereof. The light incident surface 21 is vertical to the light output surface 22.

The light guide 20 comprises a light guide surface 25 at a side below thereof corresponding to the light output surface 22 vertical to a flat surface of the light output direction. The light guide surface 25 is a bevel connecting to the contour below the light incident surface 21 at one side, extending upward to the center of the light guide 20 at the other side, making longitudinal sections of the light guide 20 be in two symmetrical wedges, in which tips of the wedges touching each other. The light guide surface 25 comprises a plurality of V-shaped microstructures 251 intersecting with the bevel to define the light guide structure. Tips of the V-shapes microstructures 251 face upward, a front and a rear side (the X direction) of the light guide 20 are attached to a side plate 23 to prevent lateral light leak.

The light source modules 30 are individually disposed away from opposite ends of the light incident surface 21 of the light guide 20, the light output surface 22 of the light source module being attached directly to the light incident surface 21, enabling the light source to directly pass through the light guide 20. It is worth mentioning that the cross-section of the light guide is trapezoid, each light incident surface 21 of the light guide 20 being provided with a plurality of LED chips 301, 302, 303. The plurality of LED chips 301, 302, 303 are spaced apart from the light output surface 22 of the light guide in various distances, i.e., various distances in the Z direction in order to provide sufficient light sources.

Figure 3:
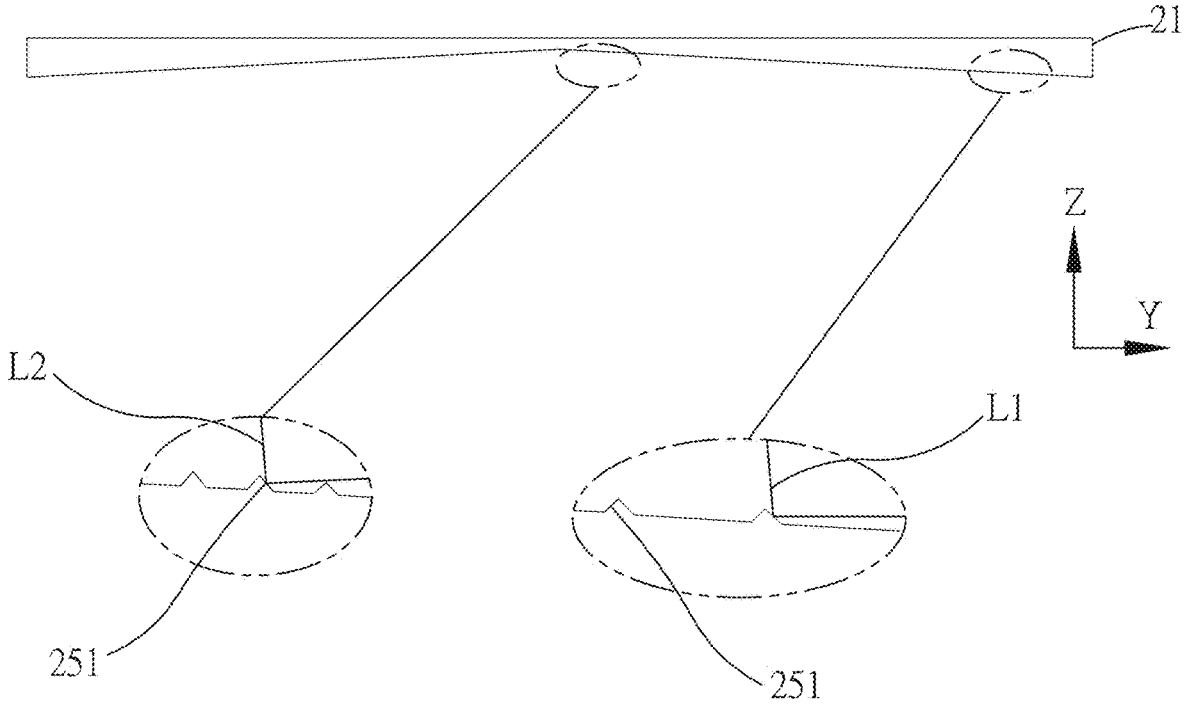
FIG. 3 is a schematic view showing an internal light path of the light guide of the vehicle signal light structure.

Please refer to FIG. 3, the light passing through the light incident surface 21 of the light guide 20 is reflected by the light guide surface 25, directing toward the light output surface 22, not only the light L1 close to the light incident surface 21 but also the light L2 close to the center of the light guide 20 is reflected by the V-shaped microstructures 251 and directing to the light output surface 22. Under the premise of being able to be reflected by the V-shaped microstructures 251, the tips of the V-shaped microstructures 251 is optional to face upward or downward.

Figure 4:
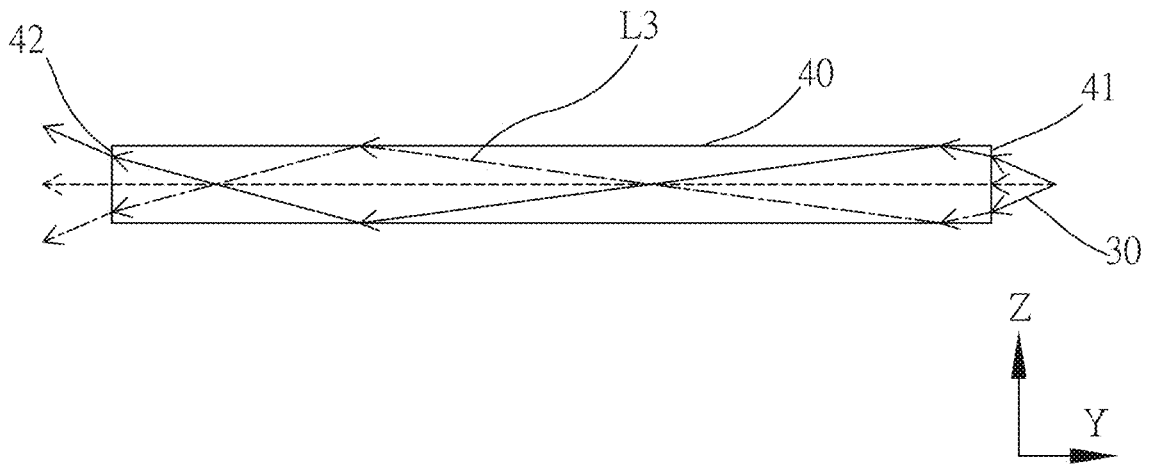
FIG. 4(Prior Art)
FIG. 4 is a schematic view showing an internal light path of a conventional elongated light guide.
Figure 5:
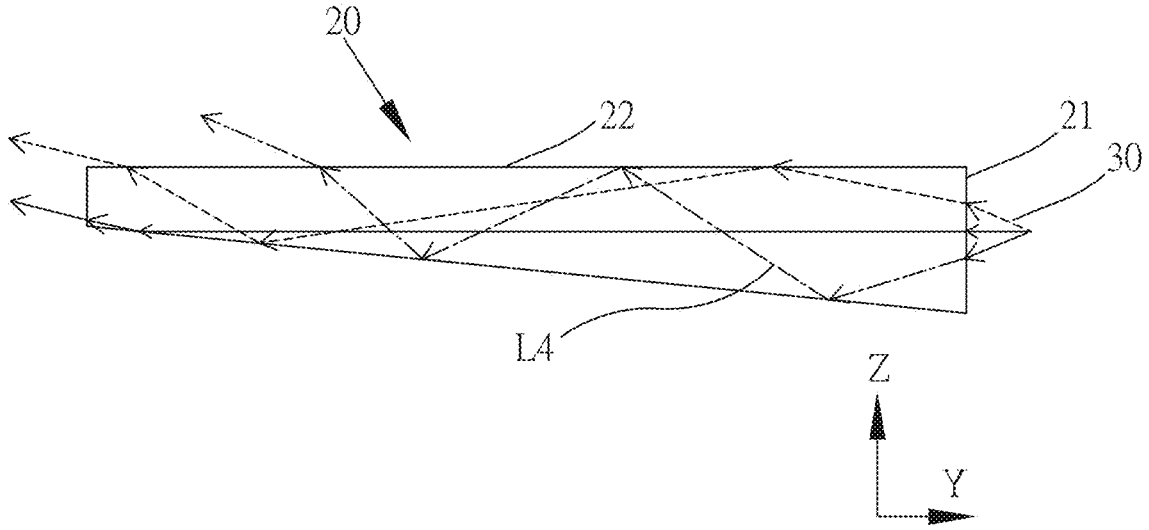
FIG. 5 is another schematic view showing the internal light path of the light guide.

Please refer to FIG. 3-FIG. 5, if an even-shaped elongated light guide 40 and side lights (light source modules 30) are deployed as shown in FIG. 4, LED being point light, the light L3 passes through the light guide 40 at a side of the light incident surface, due to the Law of Refraction (Snell's Law), the light continuing performing a total reflection in the light guide 40 to emit the light at the other side 42, unable to emit the light in the Z direction. If the light guide 20 of the instant disclosure is deployed as shown in FIG. 5, the wedge structure of the light guide 20 (at ZY cross-section) enables the light L4 to touch the bevel at the bottom multiple times to gradually change angles of reflection, the light L4 capable of emitting the light in the Z direction, or having better chances to be reflected by the V-shaped microstructures 251 and pass through the light output surface 22, the closer to the light guide 20 at left side of FIG. 5, the more likely the light is emitted in the Z direction. LED chips 301, 302, 303 at various positions in the Z direction capable of reflecting the light and emitting the light to the light output surface 22 with the wedge structure.

Under the premise of the above-mentioned, the higher the density of the V-shaped microstructures 251, the more light sources of the corresponding areas are reflected. Therefore, adjusting the quantity of the microstructures enables to adjust the brightness of the light at various positions.

Figure 6:
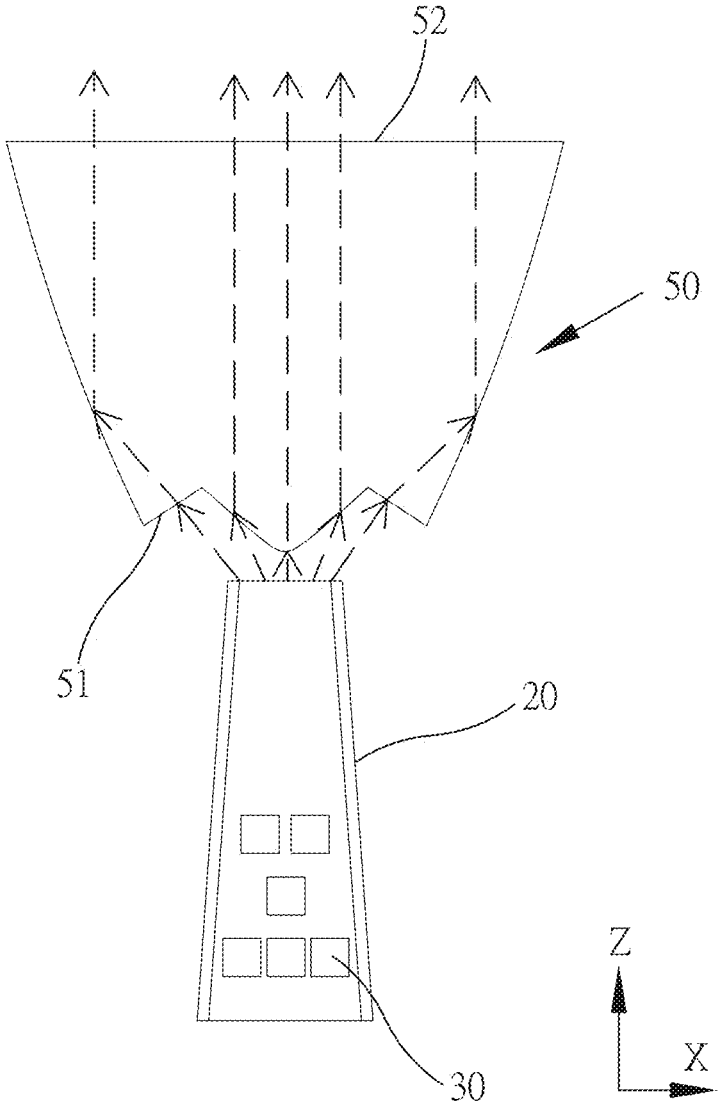
FIG. 6 is a schematic view showing an internal light path of the collimator.

Please refer to FIG. 1, FIG. 2, and FIG. 6, the collimator 50 is also an elongated light guide. An extending direction of the collimator 50 is identical to an extending direction of the light guide 20. The collimator 50 is an identical contour in the extending direction, i.e., the cross-section of the collimator 50 at various positions of the Y direction is the same. The light output surface 52 of the collimator 50 is a flat surface or an arc surface. The light incident surface 51 of the collimator 50 faces to the linear light pattern of the light output surface 22 of the light guide 20. The light from the light output surface 22 of the light guide 20 is collimated by the collimator 50, and then shines outside of the light output surface 52 of the collimator 50.

Figure 7:
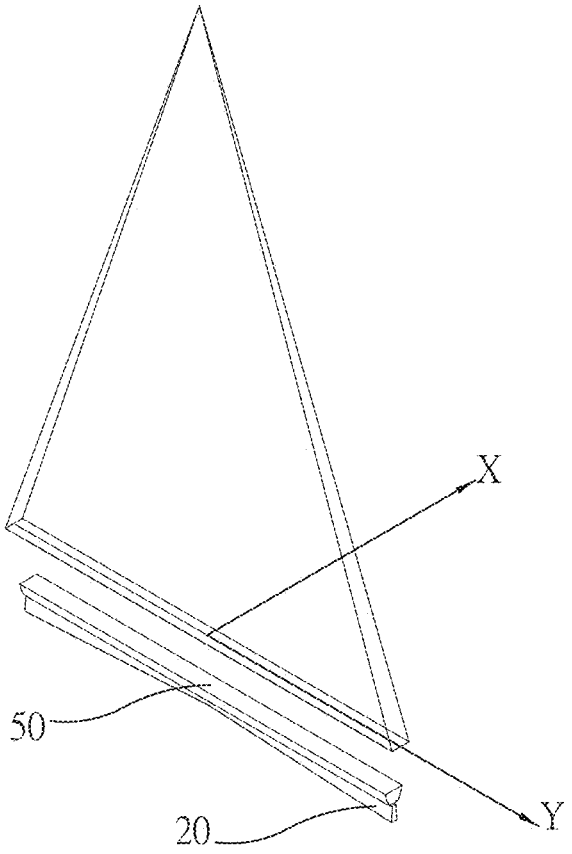
FIG. 7 is a schematic view showing a visual effect of observing direction of the vehicle signal light structure.
Figure 8:
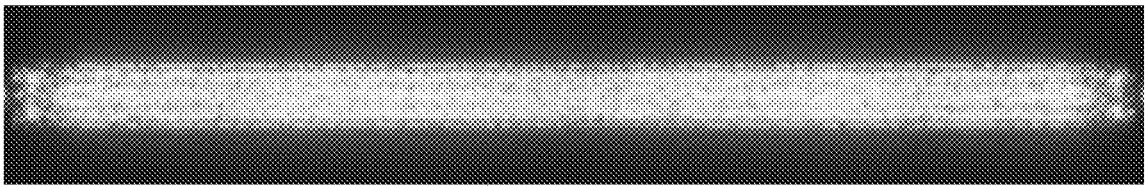
FIG. 8 is a schematic view showing a visual simulation effect of FIG. 7.

Please refer to FIG. 7 illustrating eyes of an observer being directly in front of the light output surface 52 of the light structure, the eyes of the observer being vertical to the light output surface. The upper part of FIG. 7 deploys a tip of a cone to simulate a position of the eyes of the observer, the cone comprising a range served as a simulative range of brightness observed by the eyes of the observer, a box at the bottom of the cone illustrating a simulative area of the eyes of the observer observes. The result is displayed in FIG. 8, the zero visual effects of the eyes of the observer being an even elongated light pattern.

Figure 9:
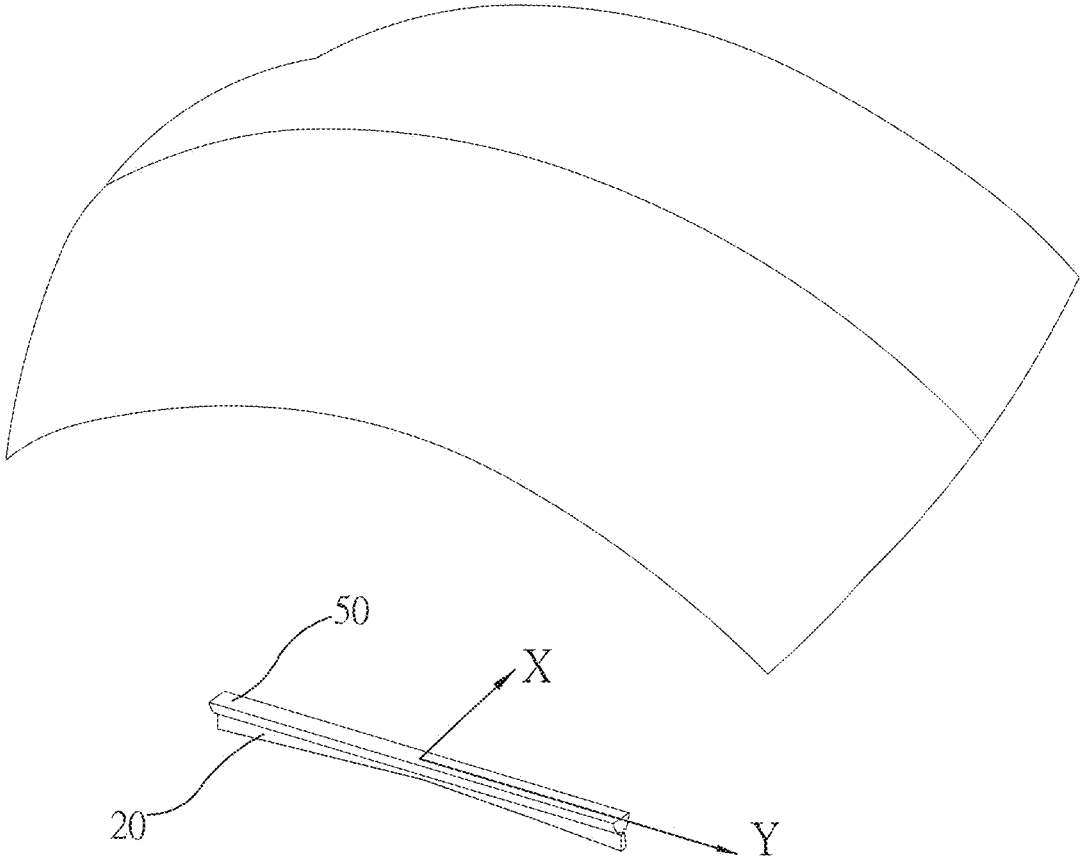
FIG. 9 is a schematic view showing a simulation of a light intensity in various directions of the vehicle signal light structure.
Figure 10:
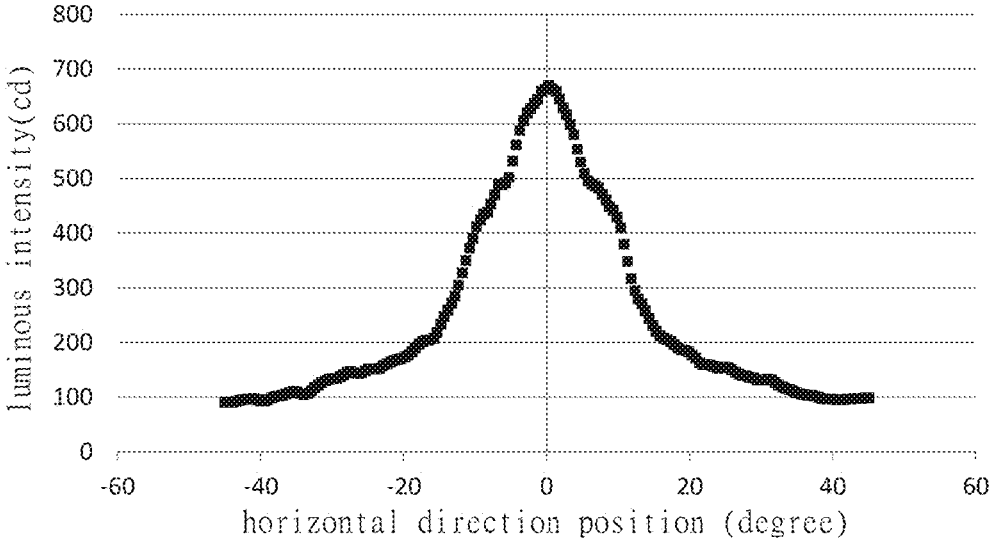
FIG. 10 and FIG. 11 are schematic views showing the simulation of the light intensity distribution in a horizontal direction and in a vertical direction of FIG. 9.
Figure 11:
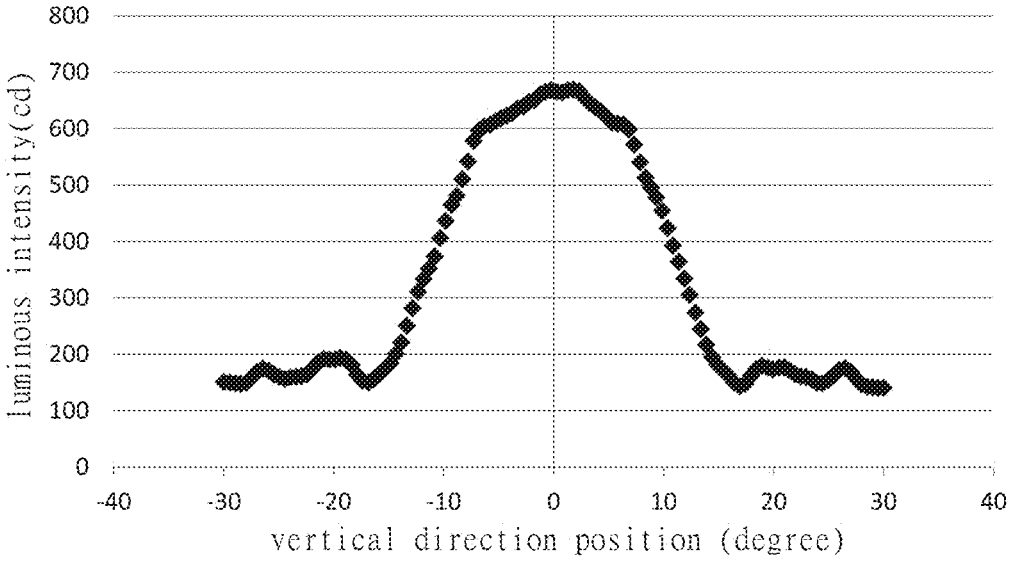

Please refer to FIG. 9 illustrating a schematic view of a simulative light intensity direction, facing the Z direction, the opening angle in the X direction being ±45 degrees, the opening angle in the Y direction being ±30 degrees. FIG. 10 and FIG. 11 illustrate a light intensity distribution in a horizontal direction (the Y direction) and in a vertical direction (the X direction) of FIG. 9, simulating the light intensity (unit cd), the daytime running light of the present disclosure has the light intensity of nearly 700 cd in the center, at least 500 cd in the horizontal and vertical opening angles within ±10 degrees, and at least 500 cd in the horizontal direction within ±15 degrees of opening angles. The light intensity, the range covered by the light is about ±45 degrees in the X direction and ±30 degrees in the Y direction. As shown above, the light intensity in the center part is stronger because the light passes through the light guide and its V-shaped structure, which turns the light from the Y direction to the Z direction, and the collimator converges the light in the X direction. Two optical components are deployed to meet various light regulation requirements.

What is claimed is:

1. A vehicle signal light structure, comprising:

a light guide, having an elongated light output surface, a light incident surface being disposed away from opposite ends of the light output surface, and a light guide surface being disposed below the light output surface;

wherein the light guide surface is tilted upward from a side of the light incident surface to the center of the light guide;

wherein the light guide surface has a plurality of V-shaped microstructures defining a light guide structure;

wherein a light passing through the light incident surface of the light guide is reflected by the light guide surface, and then directing toward the light output surface;

wherein a cross-section of the light guide is trapezoid, the light guide surface is parallelly to the light output surface in the cross-section, a width of the light output surface is smaller than a width of the light guide surface;

at least two light source modules, being individually disposed away from opposite ends of the light incident surface of the light guide;

wherein each of the two light source modules have a plurality of light sources, and the plurality of light sources are spaced apart from the light output surface of the light guide in various distances;

a collimator, wherein an extending direction of the collimator is identical to an extending direction of the light output surface of the light guide;

wherein the light incident surface of the collimator faces to the light output surface of the light guide, the light from the light output surface of the light guide is collimated by the collimator, and then shines outside of the light output surface of the collimator.

2. The vehicle signal light structure of claim 1, wherein the collimator has an identical contour in an extending direction.

3. The vehicle signal light structure of claim 1, wherein longitudinal sections of the light guide are in two symmetrical wedges.

4. The vehicle signal light structure of claim 1, wherein the light from the light source modules passes through the light incident surface directly.

5. The vehicle signal light structure of claim 1, wherein a part of the light emitted by the light source modules is reflected at least twice in the light guide.

6. The vehicle signal light structure of claim 1, wherein the light guide surface at various positions has a plurality of V-shaped microstructures with various distribution densities.

7. A daytime running light comprises the vehicle signal light structure of claim 1.

* * * * *